US011528989B1

(12) United States Patent
Meeks

(10) Patent No.: US 11,528,989 B1
(45) Date of Patent: Dec. 20, 2022

(54) DUST WAND CLEANER THAT NEEDS NO ELECTRICITY

(71) Applicants: Robert B. Jordan, IV, Mt. Gilead, NC (US); Eddie Alexander Meeks, Greensboro, NC (US)

(72) Inventor: Eddie Alexander Meeks, Greensboro, NC (US)

(73) Assignees: Robert B. Jordan, IV, Mt. Gilead, NC (US); Eddie Alexander Meeks, Greensboro, NC (US)

( * ) Notice: Subject to any disclaimer, the term of this patent is extended or adjusted under 35 U.S.C. 154(b) by 257 days.

(21) Appl. No.: 16/895,454

(22) Filed: Jun. 8, 2020

(51) Int. Cl.

| | |
|---|---|
| ***A46B 17/00*** | (2006.01) |
| ***A46B 17/06*** | (2006.01) |
| ***A46B 9/02*** | (2006.01) |
| ***A47L 25/00*** | (2006.01) |

(52) U.S. Cl.
CPC ..... *A46B 17/06* (2013.01); *A46B 9/026* (2013.01); *A47L 25/00* (2013.01); *A46B 2200/3026* (2013.01)

(58) Field of Classification Search
CPC ..... A46B 17/06; B08B 9/023; A47L 25/00
See application file for complete search history.

(56) References Cited

U.S. PATENT DOCUMENTS

| | | | | |
|---|---|---|---|---|
| 1,714,346 | A * | 5/1929 | Carleton | A63B 60/36 473/282 |
| 5,094,557 | A * | 3/1992 | Nelson | A63B 60/36 401/268 |
| 6,530,114 | B2 | 3/2003 | Bailey et al. | |
| D691,772 | S * | 10/2013 | Blaisdell | D32/35 |
| 2003/0079309 | A1 | 5/2003 | Vandenbelt et al. | |
| 2010/0101043 | A1 | 4/2010 | Kim et al. | |

* cited by examiner

*Primary Examiner* — Shay Karls
(74) *Attorney, Agent, or Firm* — MacCord Mason PLLC

(57) ABSTRACT

A dust wand cleaner for dust wands that have radially-arrayed fibers that protrude to a define a generally cylindrical fiber head. The cleaner includes two open end sections and a midsection. Each end section has an internal passageway that preferably narrows from a first width that easily receives an inserted end of a generally cylindrical fiber head of a dust wand to a second width that compresses the fibers of the dust wand. The midsection has an internal passageway that is aligned with the internal passageways of the end sections, that is wider than the second width and that has inwardly extending bristles. When a dust wand is passed through the aligned passageways of the two open end sections and the midsection, debris adhering to the dust wand fibers is removed from the dust wand by being combed by the bristles.

19 Claims, 3 Drawing Sheets

DUST WAND CLEANER THAT NEEDS NO ELECTRICITY

BACKGROUND OF THE INVENTION

This invention is drawn to the field of brushing, scrubbing and general cleaning, and more particularly, to a novel dust wand cleaning appliance.

Dust wands (usually having lambswool or polyester fibers) are well-known implements which remove dust and other foreign matter when they are manually wiped across the surfaces of furniture, walls, artifacts and other objects.

Dust wands, particularly lambswool dusters, are reusable implements that are generally effective at dust and foreign matter removal. They typically enjoy a long useful life but need to have accumulated dust and foreign matter removed from them by periodic cleaning to restore their cleaning power. In the usual case, a rapid back-and-forth movement or spinning action is employed to mechanically shake loose accumulated dust and foreign matter from the wand.

Electrically-powered devices to vacuum the fibers of the wand are known, but their complication adds to their expense. Examples of such electrically-powered devices can be seen in U.S. Pat. No. 6,530,114 to Bailey et al. and U.S. Patent Publications 2003/0079309 to Vandenbelt et al. and 2010/0101043 to Kim et al. There remains a need in the art for a simple, reliable, inexpensive, easy-to-use tool for cleaning dust wands to restore their cleaning ability.

SUMMARY OF THE INVENTION

The present invention fulfills one or more of these needs in the art by providing a dust wand cleaner for dust wands that have radially-arrayed fibers that protrude to a define a generally cylindrical fiber head, The cleaner has two open end sections and a midsection. Each end section has an internal passageway. The midsection has an internal passageway that is aligned with the internal passageways of the end sections and that has inwardly extending bristles, so that when a dust wand is passed through the aligned passageways of the two open end sections and the midsection, debris adhering to the dust wand fibers is loosened from the dust wand. The passageways of the end sections preferably narrow from a first width that easily receives an inserted end of a generally cylindrical fiber head of a dust wand to a second width that compresses the generally cylindrical fiber head of the dust wand.

Preferably, the cleaner needs no electricity and therefore is free of sources of electricity.

The bristles may be metal. The bristles are desirably arrayed substantially completely around the internal passageway of the midsection. The bristles may be arrayed in multiple rows that are spaced from one another along the internal passageway of the midsection.

The end sections are preferably readily separable from the midsection, permitting access to the bristles for cleaning of the bristles. For example, each end section may be joined to the midsection by a bayonet mount so the end sections are readily separable from the midsection, permitting access to the bristles for cleaning of the bristles. The two end sections may be identical.

The passageway of the midsection may be wider than the second width of the passageway of an end section. Typically, for each end section, the passageway's first width is further from the midsection than the passageway's second width. The bristles are preferably mounted in an expansion chamber in the midsection.

BRIEF DESCRIPTION OF THE DRAWINGS

The invention will be better understood by a reading of the Detailed Description of the Examples of the Invention along with a review of the drawings, in which.

DETAILED DESCRIPTION

Figure 1:
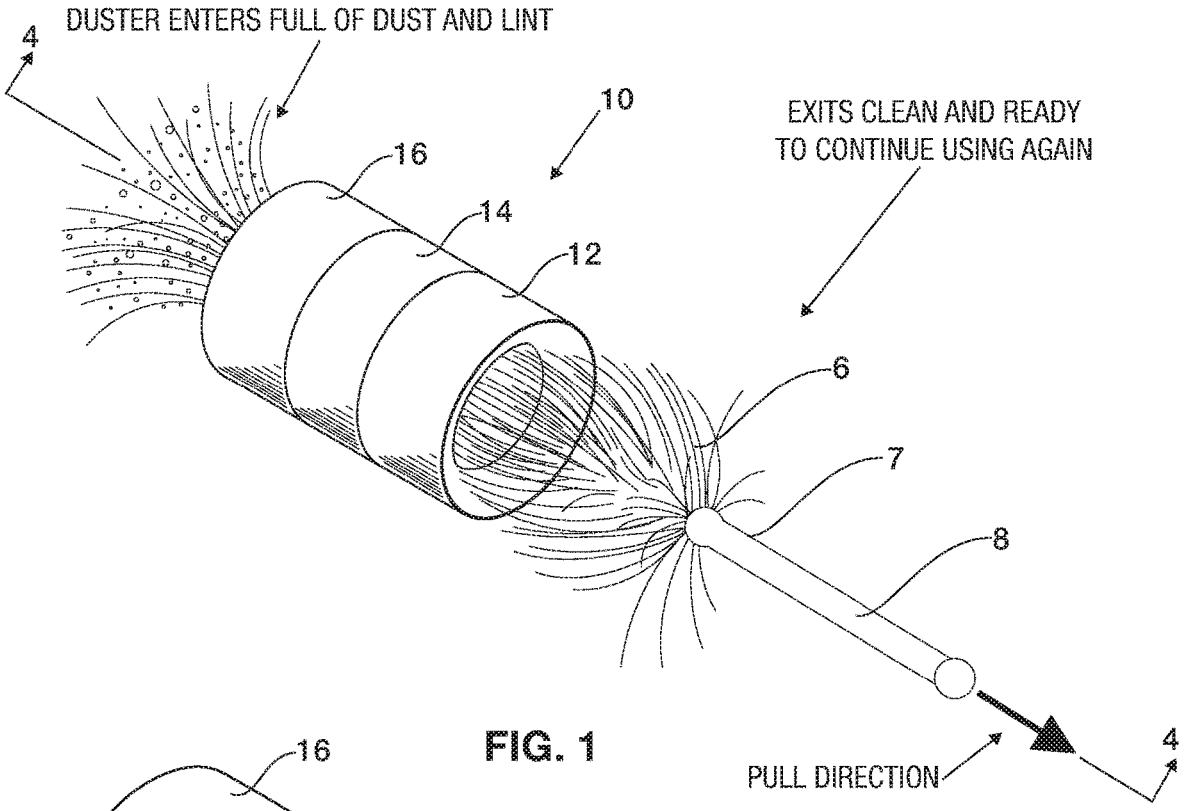
FIG. 1 is a perspective view of a dust wand passing through a cleaner.

FIG. 1 shows a dust wand 8 having a fibrous head 6 on a handle 7. The fibers of the head 6 radiate from all around the wand handle 7 to form a generally cylindrical fiber head 6. As seen in FIG. 1, the wand 8 is being pulled, handle-first through a dust wand cleaner 10. The cleaner 10 is used with three sections 12, 14, and 16 assembled together, such as the cleaner as shown in FIG. 1.

Figure 2:
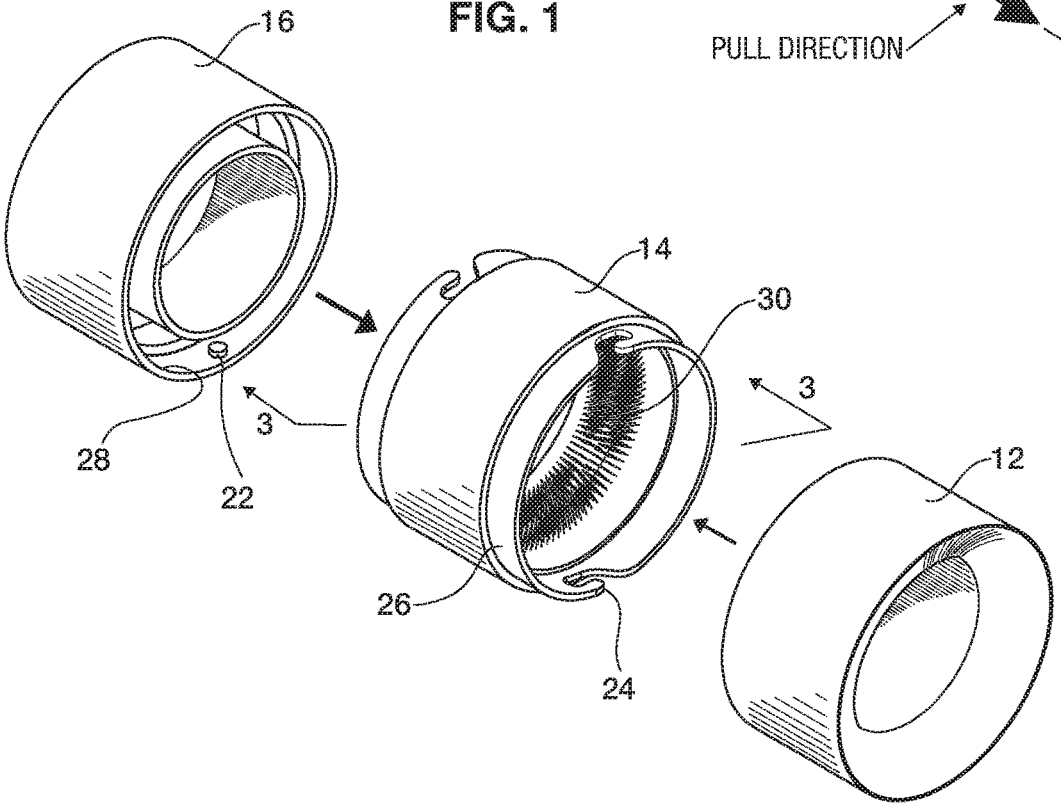
FIG. 2 is an exploded view of the components of the cleaner shown in FIG. 1.

The sections 12, 14, and 16 are shown separated in FIG. 2. The end sections 12 and 16 can be identical but are used with one in a reversed position from the other. They join to the midsection 14. As shown in FIG. 2, the sections may join using a bayonet mount. The inner ends 28 of the peripheral walls of the end sections 12 and 14 have an inner protrusion 22, and the narrowed end peripheral walls 26 on each end of the midsection 14 has cutout 24 sized and positioned so the protrusion 22 of an end section can be inserted into the cutout 24, followed by turning, making the bayonet mount. The bayonet mount can vary in numerous ways, including, for example: by locating the protrusion on the midsection and the cut outs on the end sections; and making the narrowed end peripheral walls be on the end sections to fit into non-narrowed end peripheral walls on the midsection. The end sections can be releasably joined to the midsection in other ways, such as, for example, by screwing mating threaded ends together or a press fit.

Figure 3:
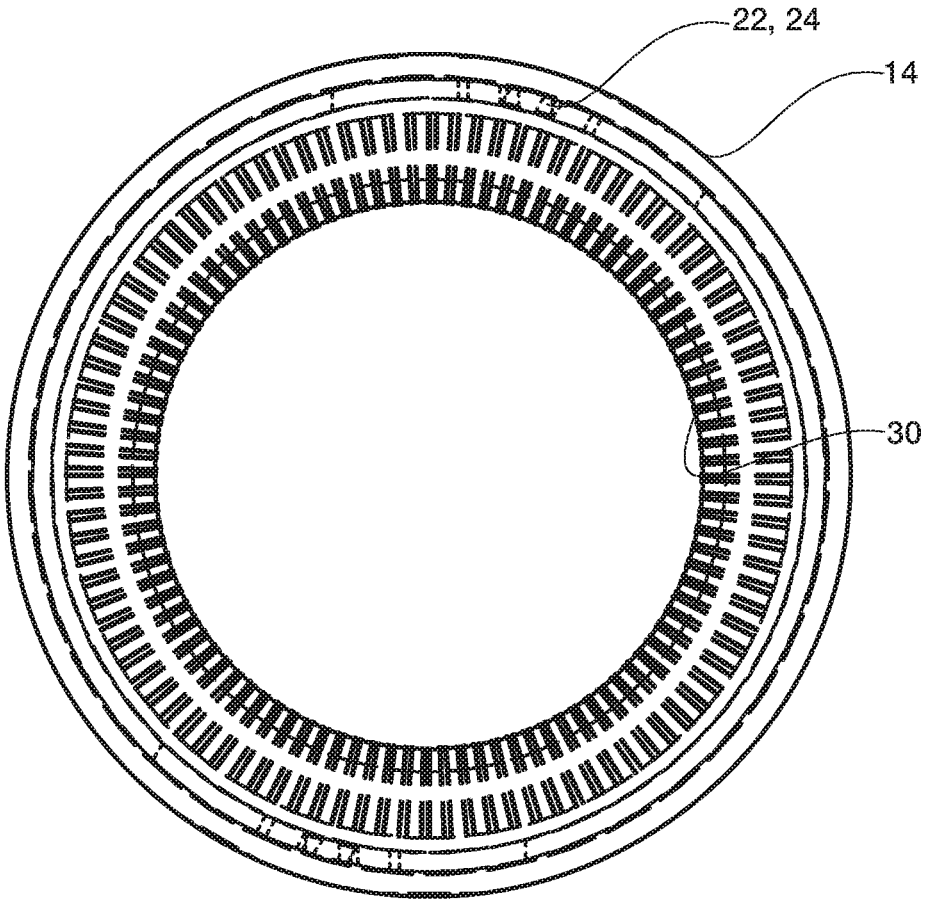
FIG. 3 is a sectional view of the cleaner of FIG. 2 taken along lines 3-3 and looking in the direction of the arrows.

As seen in FIG. 2, the midsection 14 has an inner array of bristles 30. The bristles 30 extend inwardly from the midsection 14. The bristles may be wire bristles. The bristles may be metal or a polymer or natural straw, etc. As used herein, the word "bristle" is to be broadly construed to include items that may also be called "tines." The bristles can be seen more clearly in the view of FIG. 3. Also visible in FIG. 3 in phantom are the protrusion 22 and cutout 24 of one of the connected end sections.

Figure 4:
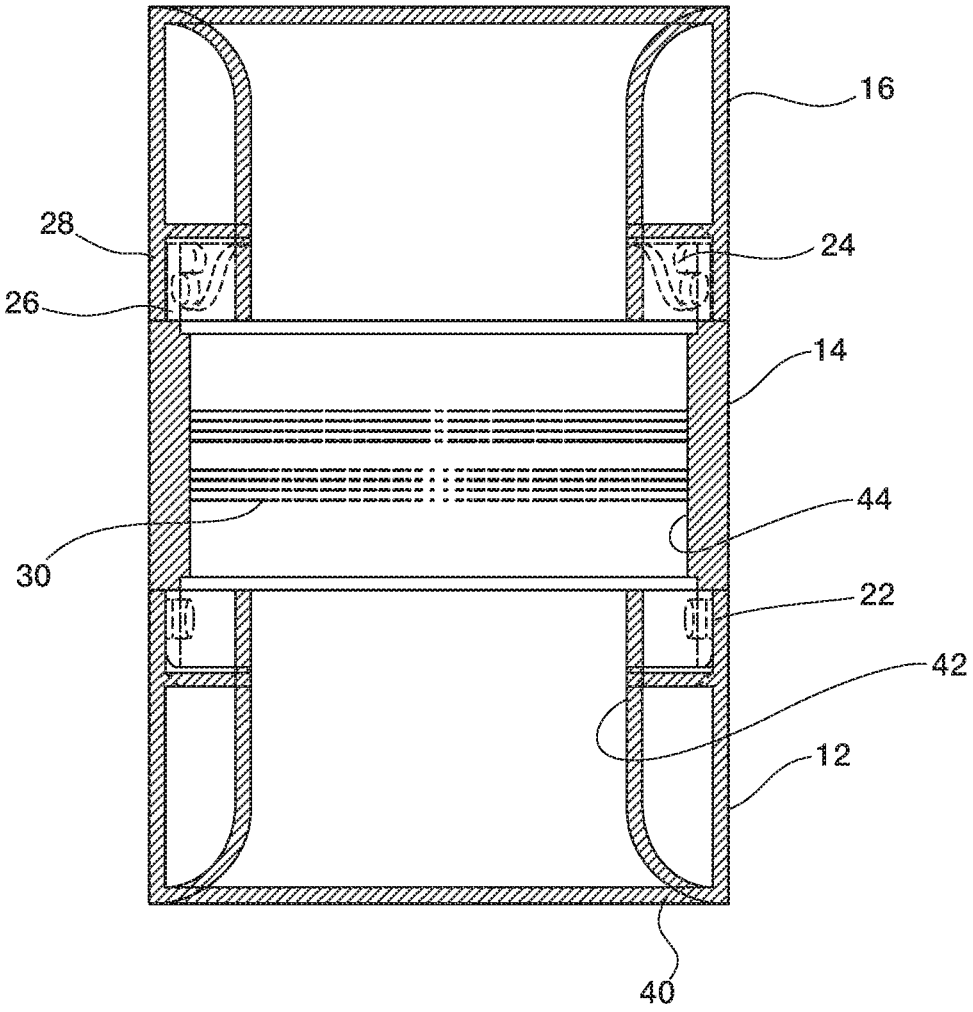
FIG. 4 is a sectional view of the cleaner FIG. 1 taken along lines 4-4 and looking in the direction of the arrows.

The sectional view of the assembled cleaner shown in FIG. 4 shows that the bristles 30 can be arranged in several rows. FIG. 4 shows that each end section 12 and 16 has an internal passageway that narrows from a first width 40 that easily receives an inserted end of a generally cylindrical fiber head of a dust wand to a second width 42 that compresses the generally cylindrical fiber head of the dust wand. The difference in diameters results in a reduction of the internal passageway's width. Providing this narrowing width configuration on both the infeed and outfeed ends of the cleaner provides better cleaning than if the reduction is only used on one end. In addition, making both ends mirror copies of one another enables the user can run the dust wand through either way with good results.

Applicant has also found that it is preferable to have the inner ends of the bristles 30 close to the same inner diameter as the second width 42 of the passageway and for the midsection to have a length adjacent the bristles that is not negligible. This length in the midsection results in an expansion chamber 44 that lets the cylindrical body of fibers of the dust wand that has been compressed by being fed into the entrance end section expand up against the bristles before being directed back inward by the wall of the second width 42 as the fiber head is pulled out the exit end section.

The expansion chamber 44 also permits the use of finer, more flexible bristles 30. The expansion chamber 44 has room for the bristle tips to flex when combing the fibers and then spring back to their static position as the dust wand completes its journey through the cleaner. Different size cleaners can be made for dust wands that have substantially different diameters of fiber cylinders.

In operation, the end sections are assembled to the midsection to make the cleaner. The dust wand is then passed through the cleaner (preferably but not necessarily, handle-first). As the fibers of the dust wand pass through the initial end section, they are compressed by the reducing diameter of the passageway in that end section. Then, upon reaching the expansion chamber 44, they rebound to the more-extended shape and quickly encounter the bristles 30 that comb through the fibers, loosening and removing debris attached to the fibers. Then the fibers encounter the narrowed passageway of the exit-side end section where further cleaning takes place, depositing most removed debris within the cleaner 10. The disclosed tool is a simple, reliable, inexpensive, easy-to-use tool for cleaning dust wands to restore their cleaning ability.

Certain modifications and improvements will occur to those skilled in the art upon reading the foregoing description. It should be understood that all such modifications and improvements have been omitted for the sake of conciseness and readability but are properly within the scope of the following claims.

What is claimed is:

1. A dust wand cleaner for dust wands that have radially-arrayed fibers that protrude to a define a generally cylindrical fiber head comprising two open end sections and a midsection, each end section having an internal passageway configured to allow an inserted end of a generally cylindrical fiber head to pass through the end section, the midsection having an internal passageway that is aligned with the internal passageways of the end sections and that has inwardly extending bristles, so that when a dust wand is passed through the aligned passageways of the two open end sections and the midsection, debris adhering to the dust wand fibers is loosened from the dust wand, wherein the end sections are readily separable from the midsection, permitting access to the bristles for cleaning of the bristles.

2. A dust wand cleaner as claimed in claim 1 comprising wherein the dust wand cleaner is selected from the group consisting of a. cleaners whose end sections and midsection are generally cylindrical shape, and b. cleaners the bristles of which extend from left, right, top, and bottom sides into the internal passageway.

3. A dust wand cleaner as claimed in claim 2 wherein the bristles are mounted in an expansion chamber in the midsection.

4. A dust wand cleaner as claimed in claim 1 wherein the internal passageways way of the end sections narrow from a first width that easily receives an inserted end of a generally cylindrical fiber head of a dust wand to a second width that compresses the generally cylindrical fiber head of the dust wand.

5. A dust wand cleaner as claimed in claim 4 wherein for each end section, the passageway's first width is further from the midsection than the passageway's second width.

6. A dust wand cleaner as claimed in claim 1 that is free of sources of electricity.

7. A dust wand cleaner as claimed in claim 1 wherein the bristles are metal.

8. A dust wand cleaner as claimed in claim 1 wherein the bristles are arrayed substantially completely around the internal passageway of the midsection.

9. A dust wand cleaner as claimed in claim 1 wherein the bristles are arrayed in multiple rows that are spaced from one another along the internal passageway of the midsection.

10. A dust wand cleaner as claimed in claim 1 wherein each end section is joined to the midsection by a bayonet mount so the end sections are readily separable from the midsection, permitting access to the bristles for cleaning of the bristles.

11. A dust wand cleaner as claimed in claim 1 wherein the two end sections are identical.

12. A dust wand cleaner for dust wands that have radially-arrayed fibers that protrude to a define a generally cylindrical fiber head comprising two open end sections and a midsection, each end section having an internal passageway configured to allow an inserted end of a generally cylindrical fiber head to pass through the end section, the midsection having an internal passageway that is aligned with the internal passageways of the end sections and that has inwardly extending bristles, so that when a dust wand is passed through the aligned passageways of the two open end sections and the midsection, debris adhering to the dust wand fibers is loosened from the dust wand, wherein the internal passageways way of the end sections narrow from a first width that easily receives an inserted end of a generally cylindrical fiber head of a dust wand to a second width that compresses the generally cylindrical fiber head of the dust wand and the passageway of the midsection is wider than the second width of the passageway of an end section.

13. A dust wand cleaner as claimed in claim 12 that is free of sources of electricity.

14. A dust wand cleaner as claimed in claim 12 wherein the bristles are metal.

15. A dust wand cleaner as claimed in claim 12 wherein the bristles are arrayed substantially completely around the internal passageway of the midsection.

16. A dust wand cleaner as claimed in claim 12 wherein the bristles are arrayed in multiple rows that are spaced from one another along the internal passageway of the midsection.

17. A dust wand cleaner as claimed in claim 12 wherein each end section is joined to the midsection by a bayonet mount so the end sections are readily separable from the midsection, permitting access to the bristles for cleaning of the bristles.

18. A dust wand cleaner as claimed in claim 12 wherein the two end sections are identical.

19. A dust wand cleaner for dust wands that have radially-arrayed fibers that protrude to a define a generally cylindrical fiber head comprising two open end sections and a midsection, the end sections being readily separable from the midsection, each end section having an internal passageway that narrows from a first width that easily receives an inserted end of a generally cylindrical fiber head of a dust wand to a second width that compresses the generally cylindrical fiber head of the dust wand, the midsection having an internal passageway aligned with the internal passageways of the end sections that is wider than the second width and that has inwardly extending bristles that are arrayed substantially completely around the internal passageway of the midsection so that when a dust wand is passed through the aligned passageways of the two open end sections and the midsection, debris adhering to the dust wand fibers is loosened and removed from the dust wand by being combed by the bristles, the dust wand cleaner being free of sources of electricity.

* * * * *